US009849898B2

(12) United States Patent
Nitti

(10) Patent No.: US 9,849,898 B2
(45) Date of Patent: Dec. 26, 2017

(54) METHOD FOR MANAGING A RAILWAY VEHICLE AND RAILWAY VEHICLE OPERATING IN ACCORDANCE WITH SUCH METHOD

(71) Applicant: TESMEC S.P.A., Milan (IT)

(72) Inventor: Antonio Nitti, Castellana Grotte (IT)

(73) Assignee: TESMEC S.P.A., Milan (IT)

( * ) Notice: Subject to any disclaimer, the term of this patent is extended or adjusted under 35 U.S.C. 154(b) by 0 days.

(21) Appl. No.: 15/108,456

(22) PCT Filed: Feb. 16, 2015

(86) PCT No.: PCT/IB2015/051129
§ 371 (c)(1),
(2) Date: Jun. 27, 2016

(87) PCT Pub. No.: WO2015/128770
PCT Pub. Date: Sep. 3, 2015

(65) Prior Publication Data

US 2016/0355202 A1 Dec. 8, 2016

(30) Foreign Application Priority Data

Feb. 25, 2014 (IT) ..... MI2014A0276

(51) Int. Cl.
*B61L 27/00* (2006.01)
*B61C 9/14* (2006.01)

(52) U.S. Cl.
CPC ..... *B61L 27/0061* (2013.01); *B61C 9/14* (2013.01)

(58) Field of Classification Search
CPC ..... B61L 27/0061; B61C 9/14
(Continued)

(56) References Cited

U.S. PATENT DOCUMENTS 2,106,843 A 2/1938 Wilhelm et al.
5,010,975 A * 4/1991 Sommer ..... B60K 17/351 180/248
(Continued)

FOREIGN PATENT DOCUMENTS

DE 857387 C 11/1952
DE 2409333 A1 9/1975
(Continued)

OTHER PUBLICATIONS

International Application No. PCT/IB2015/051129 International Search Report dated Apr. 30, 2015.

*Primary Examiner* — Jelani A Smith
*Assistant Examiner* — James E Stroud
(74) *Attorney, Agent, or Firm* — King & Schickli, PLLC

(57) ABSTRACT

A method for managing a railway vehicle which comprises a motor (6) connected to a chassis (2), a first (3) and a second axle (4) functionally connected to the motor (6); a first transmission member (7) of hydrostatic type and a second transmission member (8) of hydrodynamic type (generally defined "gear", which can be of hydrodynamic or mechanical type) for connecting the motor to the first and second axle; the method comprising the steps of selecting a configuration for managing the vehicle (1) and switching said vehicle between a first operative condition, in which the first transmission member (7) or the second transmission member (8) is active, and a second operative condition, in which both the first transmission member (7) and the second transmission member (8) are simultaneously active, at least as a function of the vehicle (1) management configuration.

8 Claims, 1 Drawing Sheet

(58) Field of Classification Search
USPC ..... 701/20
See application file for complete search history.

(56) References Cited

U.S. PATENT DOCUMENTS

| | | | | |
|---|---|---|---|---|
| 2007/0144283 | A1* | 6/2007 | Hasegawa | B60K 17/04 74/325 |
| 2009/0306869 | A1* | 12/2009 | Wandel | B60W 10/02 701/67 |
| 2011/0287890 | A1* | 11/2011 | Staudinger | B60K 17/28 477/77 |

FOREIGN PATENT DOCUMENTS

| | | | |
|---|---|---|---|
| FR | 1244123 | A | 10/1960 |
| FR | 1244123 | A1 * | 10/1960 |
| GB | 685795 | A | 1/1953 |
| GB | 689057 | A | 3/1953 |

* cited by examiner

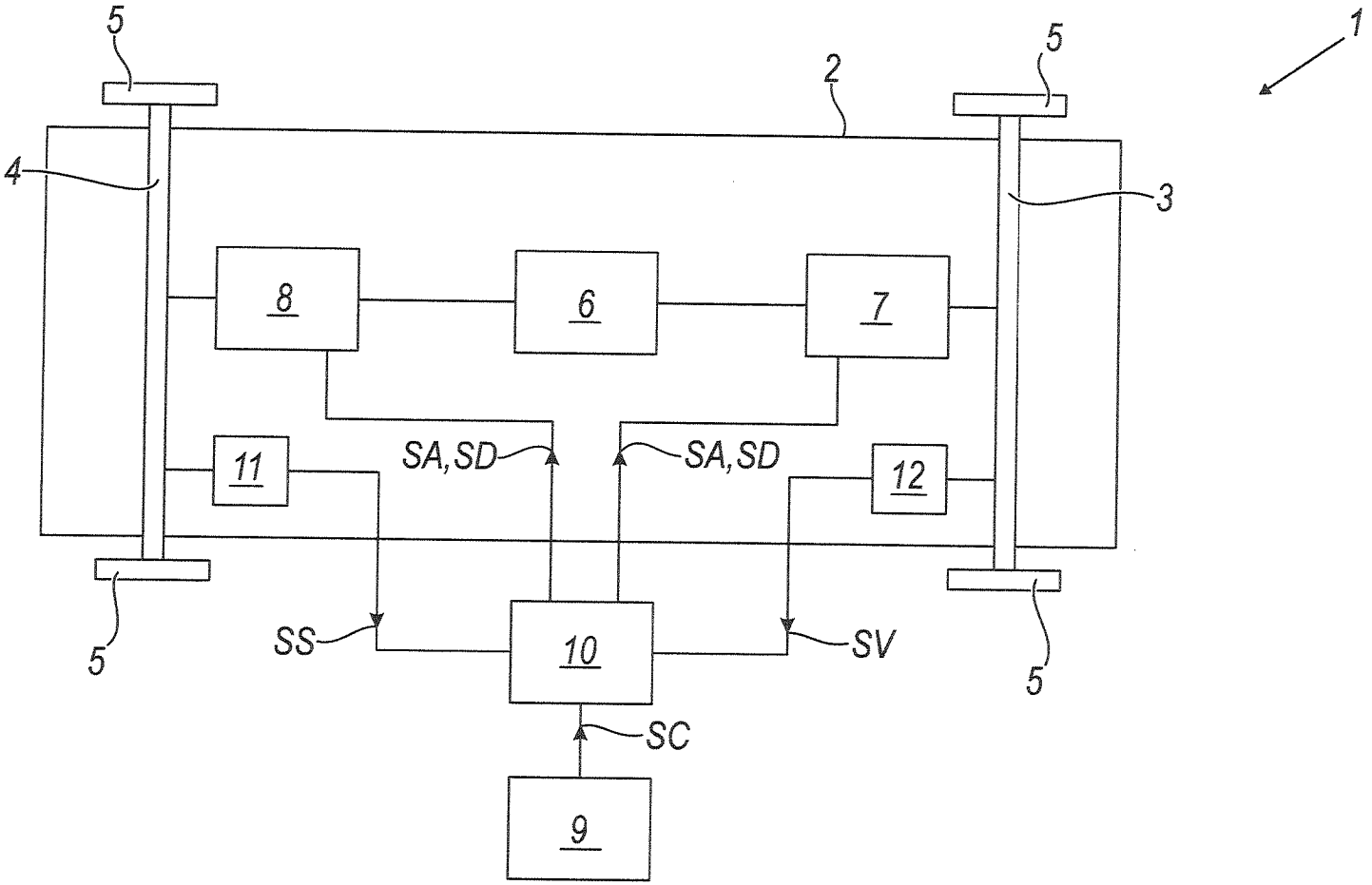
1
2
3
4
5
5
5
5
6
7
8
9
10
11
12
SA, SD
SA, SD
SC
SS
SV

METHOD FOR MANAGING A RAILWAY VEHICLE AND RAILWAY VEHICLE OPERATING IN ACCORDANCE WITH SUCH METHOD

The subject of the present invention is a method for managing a railway vehicle and a railway vehicle that operates in accordance with such method.

Merely by way of example, the present invention can be applied in wagons for the maintenance of the railway line.

The known railway vehicles, and in particular the wagons for maintaining the railway line, comprise a chassis on which two axles are mounted, each bearing two wheels.

An endothermic motor, fixed to the chassis, is connected to the axles in order to allow the movement of the vehicle along the tracks.

The endothermic motor is connected to the axles by means of transmission means, which transmit the motion from the motor to the axles.

In detail, the transmission means comprise a hydrostatic transmission member associated with the axles.

Advantageously, the hydrostatic transmission member is particularly suitable for transmitting high torques at low speed, being particularly well-suited if the vehicle must be moved with precise movements at low speed.

However, the hydrostatic transmission member has rather low efficiency, which increases the vehicle power consumption.

Alternatively, the transmission means comprise a hydrodynamic transmission member associated with the axles.

This type of transmission allows greater efficiency and increased travel comfort; it also allows precisely regulating the gear ratios. It is particularly well-suited for travel at high speeds.

Nevertheless, the hydrodynamic transmission member is not particularly suitable for low speeds and has a rigid connection with the axles.

Vehicles are also known in which both a hydrostatic transmission member is mounted on a first axle and a hydrodynamic transmission member is mounted on a second axle.

The different transmission members are activated on an exclusive basis. In other words, when the hydrostatic transmission member is activated, the hydrodynamic transmission member is deactivated and vice versa.

Adversely, in the known railway vehicles, it is not always possible to adapt the transmission to the various operating situations in an optimal manner.

In this context, the technical task underlying the present invention is to propose a method for managing a railway vehicle and a railway vehicle which operates in accordance with such method that overcome the abovementioned drawbacks of the prior art.

In particular, object of the present invention is to provide a method for managing a railway vehicle and a railway vehicle that operates in accordance with such method which allow optimizing the transmission of the motion at the various operating situations.

The specified technical task and object are substantially attained by a method for managing a railway vehicle and a railway vehicle that operates in accordance with such method comprising the technical characteristics set forth in one or more of the enclosed claims.

Further characteristics and advantages of the present invention will be clearer from the exemplifying and hence non-limiting description of a preferred but not exclusive embodiment of a method for managing a railway vehicle and a railway vehicle that operates in accordance with such method, as illustrated in the enclosed drawings in which:

FIG. 1 is a schematic representation of a railway vehicle in accordance with the present invention.

With reference to the enclosed drawing, reference number 1 overall indicates a railway vehicle in accordance with the present invention.

The vehicle 1 comprises a chassis 2, at least one first axle 3 and at least one second axle 4 connected to the chassis 2.

On each first 3 and second axle 4, respective pairs of wheels 5 are mounted to form, overall, a first and a second wheel set.

Alternatively, the vehicle 1 can comprise two first axles connected with each other and two second axles connected with each other to form two respective carriages.

A motor 6 is mounted on the chassis 2 and is connected to the first axle 3 and the second axle 4.

The motor 6 is preferably endothermic.

The motor 6 is connected to the first axle 3 by means of a first transmission member 7 of hydrostatic type. The first transmission member 7 is shaped in a manner so as to transmit the mechanical power according to two ratios that are termed herein "low gear ratio" and "high gear ratio".

In addition, the motor 6 is connected to the second axle 4 by means of a second transmission member 8 of hydrodynamic or mechanical type. Preferably, the second transmission member 8 is hydrodynamic. The second transmission member 8 comprises a gear for varying the gear ratio with a plurality of ratios.

The first transmission member 7 and the second transmission member 8 are of known type and are not described herein.

The transmission of hydrostatic type is obtained by means of opportune assembly of pumps and motors with various displacement, connected in closed circuit. For controlling the displacement of the pump/motor and hence for regulating the speed of the vehicle, a mechanical lever control can be used, or an electrical control can be used that is managed by a control unit with dedicated software.

The transmission of hydrodynamic type allows the transmission of the motion by using a torque converter interposed between the endothermic motor and the gear with a plurality of ratios.

The vehicle 1 also comprises a control compartment (not shown) for a user.

In accordance with the present invention, the first transmission member 7 and the second transmission member 8 can be jointly or separately activated as a function of a specific management configuration selected by the operator and/or a travel speed value of the vehicle 1 itself and the wheel-rail adherence value.

The vehicle 1 further comprises a control member 9 that allows the operator to select a management configuration for the vehicle 1.

The control member 9 can comprise a keyboard or a lever that, when suitably maneuvered, selects the desired configuration.

In addition, the control member 9 can comprise a distinct selector which allows the operator to select the advancing speed of the vehicle 1.

The control member 9 is placed within the control compartment.

The vehicle 1 further comprises a control unit 10 functionally connected to the control member 9 in order to receive at least one configuration signal "SC" representative of the selected management configuration.

In addition, the control unit 10 is functionally connected to the control member 9 in order to receive a speed signal representative of the selected travel speed of the vehicle.

In addition, the control unit 10 is functionally connected to the first 7 and second 8 transmission member in order to send to the latter an activation signal "SA" and/or a deactivation signal "SD" as a function of the selected configuration and/or selected speed.

The vehicle 1 further comprises a slip sensor 11 connected to the control unit 10 and acting on the first 3 or on the second axle 4 or on both for detecting a state of decreased or lack of adherence of the vehicle 1 on the rails.

The slip sensor 11 sends a slip signal "SS" to the control unit 10 representative of the diminution or loss of adherence of the vehicle 1 on the rails.

In addition, the vehicle 1 comprises a speed sensor 12 associated with the first 3 and/or second axle 4 for detecting the actual speed of the vehicle 1.

The speed sensor 12 is functionally connected to the control unit 10 for sending a speed signal "SV" representative of a detected value of actual speed.

In addition, a method for managing the railway vehicle 1 is a part of the present invention.

The method comprises the preliminary step of selecting a configuration for managing the vehicle 1.

With reference to the preferred and described embodiment, the operator selects a vehicle 1 management configuration from among a plurality of different configurations. In the illustrated example, there are four management configurations.

In accordance with the present invention, as a function of the selected management configuration, the vehicle 1 is switched between a first operative condition, in which only the first transmission member 7 or the second transmission member 8 is active, and a second operative condition, in which both the first transmission member 7 and the second transmission member 8 are simultaneously active.

In detail, the method comprises the step of selecting a first management configuration or automatic management configuration for the vehicle 1.

In addition, the method comprises the step of selecting the desired travel speed.

The activation and the deactivation of the first 7 and second transmission member 8 are determined on the basis of the actual detected speed of the vehicle.

In particular, when the actual speed of the vehicle is less than a re-set speed threshold value, both the first transmission member 7 and the second transmission member 8 are activated.

In this step, the vehicle 1 is in a transient starting or stopping step.

In such a manner, the mechanical power generated by the motor 6 is transferred both to the first 3 and to the second axle 4 in order to allow the starting or stopping of the vehicle, preventing any loss of adherence and ensuring a suitable acceleration or deceleration.

In the example described herein, the speed threshold value is 40 km/h.

When the speed of the vehicle 1 is greater than the threshold value, the first transmission member 7 is deactivated until the selected speed value is reached.

In addition, when the vehicle 1 has a travel speed greater than the above-described threshold value, the method comprises the step of detecting a state of adherence of the vehicle 1 to the track.

When a loss of adherence of the vehicle 1 is detected, the first transmission member 7 is newly activated in a manner so as to transmit mechanical power also to the first axle 3 and restore the adherence of the vehicle.

When the adherence is restored and the travel speed of the vehicle 1 is still higher than the threshold value, the first transmission member 7 is newly deactivated.

Advantageously, in the automatic configuration, the efficiency of the mechanical transmission is maximum when both the transmission members 7,8 are active in the transient starting and stopping, i.e. when there is a maximum request for transmitted mechanical power, and only the second transmission member 8 is active above the threshold speed when it is necessary to maintain high speeds.

Consequently, the fuel consumption is lower. There is also less wear of the wheels 5 and less noise.

The operator can—with the variation of the operating situations where he must operate—select a different vehicle management configuration, simultaneously deselecting the automatic management configuration.

For such purpose, the method comprises the step of selecting a second management configuration or manual management configuration for the vehicle 1. Simultaneously, the automatic configuration is deactivated.

Following the selection of the manual configuration, both the first 7 and the second 8 transmission member are activated, regardless of the speed detected for the vehicle 1. Hence, even when the vehicle 1 travels at a speed greater than the threshold value, both transmission members 7, 8 are simultaneously activated.

Such configuration is selected in the case of critical operating situations, such as if the vehicle is engaged in the removal of snow from the tracks. Indeed, in the manual configuration, both the first 3 and the second axle 4 are motorized and allow a suitable adherence and transmission of the mechanical power.

Advantageously, the selection of the manual configuration and the simultaneous deselection of the automatic configuration can also be carried out when the vehicle 1 is moving.

Preferably, the method comprises the step of selecting a third management configuration or maneuvering management configuration for the vehicle 1. Simultaneously, the automatic configuration and/or the manual configuration are deactivated.

Following the selection of the maneuvering configuration, the first transmission member 7 is activated, while the second transmission member 8 is deactivated.

Such configuration is selected for moving the vehicle 1 with a maximum maneuvering speed. Merely by way of example, such maximum maneuvering speed is 7 km/h. Such configuration allows the vehicle 1 to be moved slowly and precisely in the vicinity of a work station.

Preferably, the method comprises the step of selecting a fourth management configuration or drive management configuration for the vehicle 1. Simultaneously, the automatic configuration and/or the manual configuration and/or the maneuvering configuration are deactivated.

Following the selection of the drive configuration, the first transmission member 7 is activated with the low gear ratio and the second transmission member 8 with a first gear ratio. With "first gear ratio" it is intended the lower gear ratio.

In this configuration, the mechanical power delivered by the motor 6 is transmitted to both the axles 3,4 with high torque and reduced speed in a manner so as to allow the vehicle to drive other cars.

It should be observed that, in alternative embodiments that are equally part of the present invention, in addition to the automatic management configuration, only some of the other configurations may be provided.

The invention thus described attains the pre-established object.

Indeed, the possible switching of activation of the first and second transmission member as a function of the selected configuration allows simply optimizing the mode of the power transmission as a function if the specific situations where the vehicle must operate.

In fact, the proposed method integrates the motor and the first and second transmission member in order to optimize the functionality thereof.

For example, the selection of the automatic management configuration allowing managing the starting, the travel and the stopping of the railway vehicle in an efficient manner, reducing fuel consumption, noise and wear.

In addition, the possibility to select further and different management configurations allows the vehicle to be simply adapted to different operating situations, always with a power transmission efficiency that is optimized for the specific needs.

The invention claimed is:

1. Method for managing a railway vehicle, said vehicle comprising:

a chassis (2);

a motor (6) connected to the chassis (2);

at least one first axle (3) and at least one second axle (4) connected to the chassis (2) and functionally connected to the motor (6);

a first transmission member (7) of hydrostatic type for connecting said motor (6) to said first axle (3);

a second transmission member (8) of hydrodynamic or mechanical type for connecting said motor to said second axle (4);

the method comprising the steps of:

selecting a configuration for managing the vehicle (1);

switching said vehicle between a first operative condition, in which the first transmission member (7) or the second transmission member (8) is active, and a second operative condition, in which both the first transmission member (7) and the second transmission member (8) are simultaneously active, at least as a function of the vehicle (1) management configuration;

characterized in that the method further comprises the steps of selecting an automatic management configuration for the vehicle (1) and detecting an actual speed value of the vehicle (1); said method further comprising the step of simultaneously activating said first transmission member (7) and said second transmission member (8) when the actual speed value of the vehicle (1) is less than or equal to a speed threshold value of 40 km/h.

2. Method according to claim 1, characterized in that it comprises the step of deactivating said first transmission member (7) when the speed of the vehicle (1) is greater than said limit value.

3. Method according to claim 2, characterized in that it further comprises a step of detecting a state of adherence of the vehicle (1) to a track; said method further comprising a step of also activating said first transmission member (7), simultaneously with the activation of said second transmission member (8), when a loss of adherence state is detected.

4. Method according to claim 2, characterized in that it comprises the step of deselecting said automatic management configuration for the vehicle and selecting a manual management configuration for the vehicle; the method comprising the step of simultaneously activating said first transmission member (7) and said second transmission member (8) at least when the speed of said vehicle is greater than said speed threshold value.

5. Method according to claim 4, characterized in that it comprises the step of deselecting said automatic vehicle management configuration and/or said manual vehicle management configuration and selecting a configuration for managing the maneuvering of the vehicle; the method further comprising the step of activating said first transmission member (7) and deactivating said second transmission member (8) in order to move said vehicle with a speed lower than a maximum maneuvering speed value.

6. Method according to claim 5, characterized in that said maximum maneuvering speed value is 7 km/h.

7. Method according to claim 5, characterized in that it comprises the step of deselecting said automatic management configuration and/or said manual management configuration and/or said maneuvering management configuration and selecting a configuration for managing the driving of the vehicle; the method further comprising the step of activating said first transmission member (7) with a low gear ratio and activating said second transmission member (8) with a first gear ratio in order to move said vehicle with a speed lower than said speed threshold value.

8. Software for managing a railway vehicle operating according to a method in accordance with claim 1.

* * * * *